US006446485B1

(12) United States Patent
Tarasconi

(10) Patent No.: US 6,446,485 B1
(45) Date of Patent: Sep. 10, 2002

(54) MODULAR TOOL SUPPORT ELEMENT IN SHEET METAL BENDING BRAKES

(76) Inventor: Gianluca Tarasconi, Borgo Girolamo Cantelli, 11-I-43100 Parma (IT)

( * ) Notice: Subject to any disclaimer, the term of this patent is extended or adjusted under 35 U.S.C. 154(b) by 0 days.

(21) Appl. No.: 09/544,216

(22) Filed: Apr. 7, 2000

(30) Foreign Application Priority Data

Apr. 7, 1999 (IT) ..... RE99A0040

(51) Int. Cl.[7] ..... B21D 37/04

(52) U.S. Cl. ..... 72/481.1; 72/481.2; 72/482.91; 72/482.1

(58) Field of Search ..... 72/481.1, 482.91, 72/482.6, 482.92, 481.2, 482.1

(56) References Cited

U.S. PATENT DOCUMENTS 4,315,425 A * 2/1982 Zbornik et al. ..... 72/462
4,506,538 A * 3/1985 Jones, Jr. ..... 403/341
4,895,014 A * 1/1990 Houston ..... 72/462
5,022,256 A * 6/1991 van der Meulen ..... 269/238
5,619,885 A 4/1997 Kawano et al.
6,151,951 A * 11/2000 Kawano ..... 72/481.2

FOREIGN PATENT DOCUMENTS

EP B1494714 7/1992
EP 0767015 A1 4/1997
FR 2339485 * 8/1977 ..... 72/481.2

* cited by examiner

*Primary Examiner*—David Jones
(74) *Attorney, Agent, or Firm*—Birch, Stewart, Kolasch & Birch, LLP

(57) ABSTRACT

A modular tool support element in sheet metal bending brakes which includes an intermediary member fixed to the respective toolplate and having a lower channel for receiving the tool shank provided with a groove along its entire length, support elements for supporting the shank in the channel while leaving it free to slide along the channel, and a clamping element for clamping the shank in the channel, wherein the modular element includes at least one lower channel which has a lateral wall which is a movable jaw rotatable about a fixed shaft rigid with the body of the intermediary member, there being provided a device for causing the jaw to rotate in the tool clamping direction, and movable abutments disposed on said jaw which are able to be positioned in front of or moved away from said rotation-causing device.

27 Claims, 18 Drawing Sheets

MODULAR TOOL SUPPORT ELEMENT IN SHEET METAL BENDING BRAKES

TECHNICAL FIELD

This invention relates to bending brakes and more particularly to the means for retaining and locking the working tools used by these brakes.

BACKGROUND ART

Bending brakes generally comprise a structure supporting two vertically-positioned substantially coplanar opposing toolplates, of which one can move vertically.

To the facing edges of the toolplates are fixed the means for retaining and locking the punch and die respectively, each of these being formed from a plurality of tools aligned in succession, they having the same shape but different lengths.

The modular means for retaining and locking the tool are fixed to the respective toolplates by known means, and are arranged to receive the tool shank in a manner enabling it to be slid along an axis parallel to the toolplate edge and be locked in the desired position.

When the type of work changes, one or more tools have also to be changed, this being generally done by withdrawing or inserting the tools laterally from or into the respective retention and locking means in the direction of the edge of the metal sheet.

Withdrawing, adding or changing a tool is a particularly delicate and even dangerous operation, particularly with regard to the upper tools, which can also be very long and heavy.

For this reason, tool retention and locking means have been developed for bending brakes which enable the tool to be withdrawn vertically, in the brake working direction.

These known means are rather complicated because they have to utilize safety means to prevent the tool from falling down when it is released.

Equipment known in the art, comprising said tool retention and locking means, is fully described in EP 0494714, in which the tool retention and locking means includes a lower channel into which the upper portion of the tool, also known as the shank, is inserted.

The tool can be inserted from below into a seat having the same form as the shank, and locked in position by a plurality of pneumatically operated pistons which enter a longitudinal groove provided in the tool shank. Each of these devices also has a safety device which includes a lever-operated peg which is movable within a hole in the retention means so that when the shank has been inserted into the seat in the retention and locking means, is maintained elastically inserted in a longitudinal cavity provided in one of the vertical walls of the seat.

At this point the tool can be withdrawn in the direction of the sheet edge or, by pressing the lever, can be withdrawn in the vertical direction.

This solution is costly to implement, and in addition the peg present in the safety device is easily damaged during use, rendering it unable to perform its safety function.

SUMMARY OF THE INVENTION

An object of the invention is to overcome the aforementioned drawbacks within the framework of a rational, reliable and low-cost solution.

A further object of the invention is to provide tool retention and locking means which can be used easily and safely by the operator.

BRIEF DESCRIPTION OF THE DRAWINGS

The invention attains these and further objects by virtue of a modular tool retention and locking element having the characteristics defined in the claims. To better clarify the constructional and operational characteristics of the invention three preferred embodiments thereof are described hereinafter by way of non-limiting example and are illustrated on the accompanying drawings.

DETAILED DESCRIPTION OF THE INVENTION

The figures show the movable upper toolplate 2 of a sheet metal bending brake, which carries there below a series of aligned tools 4 having the same shape but different lengths, and forming overall the punch of the brake. Likewise the lower toolplate of the brake carries a series of usual countertools which do not concern this description and are therefore not shown.

In detail, the tools 4 forming the punch are secured to the respective toolplate 2 by a series of aligned intermediary members 6, known hereinafter simply as intermediaries, which are in mutual contact.

The intermediaries 6 are fixed to the respective upper and lower toolplates by usual means.

Figure 1:
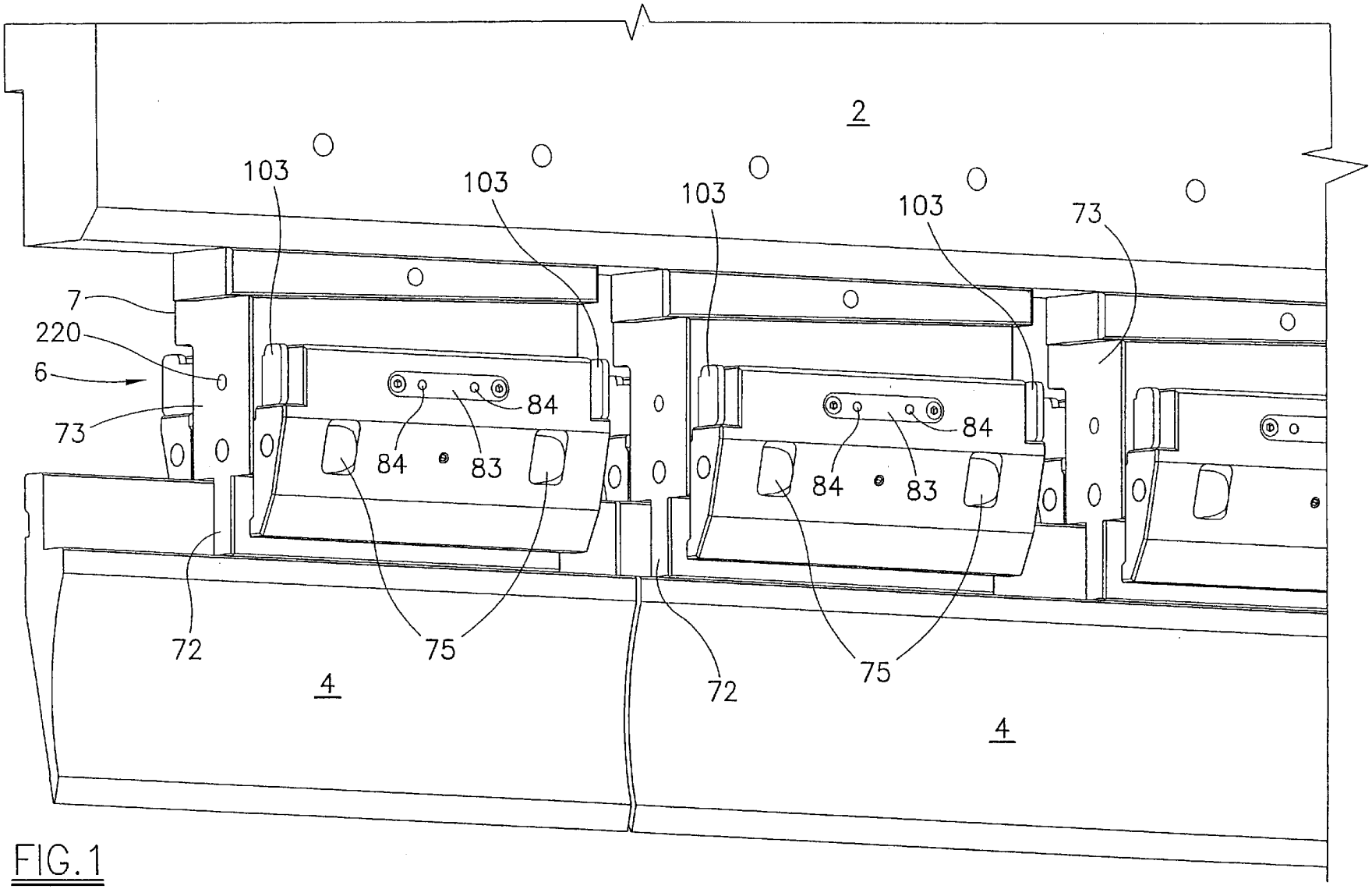
FIG. 1 is an isometric schematic view of that brake portion on which the device of the present invention is mounted.
Figure 2:
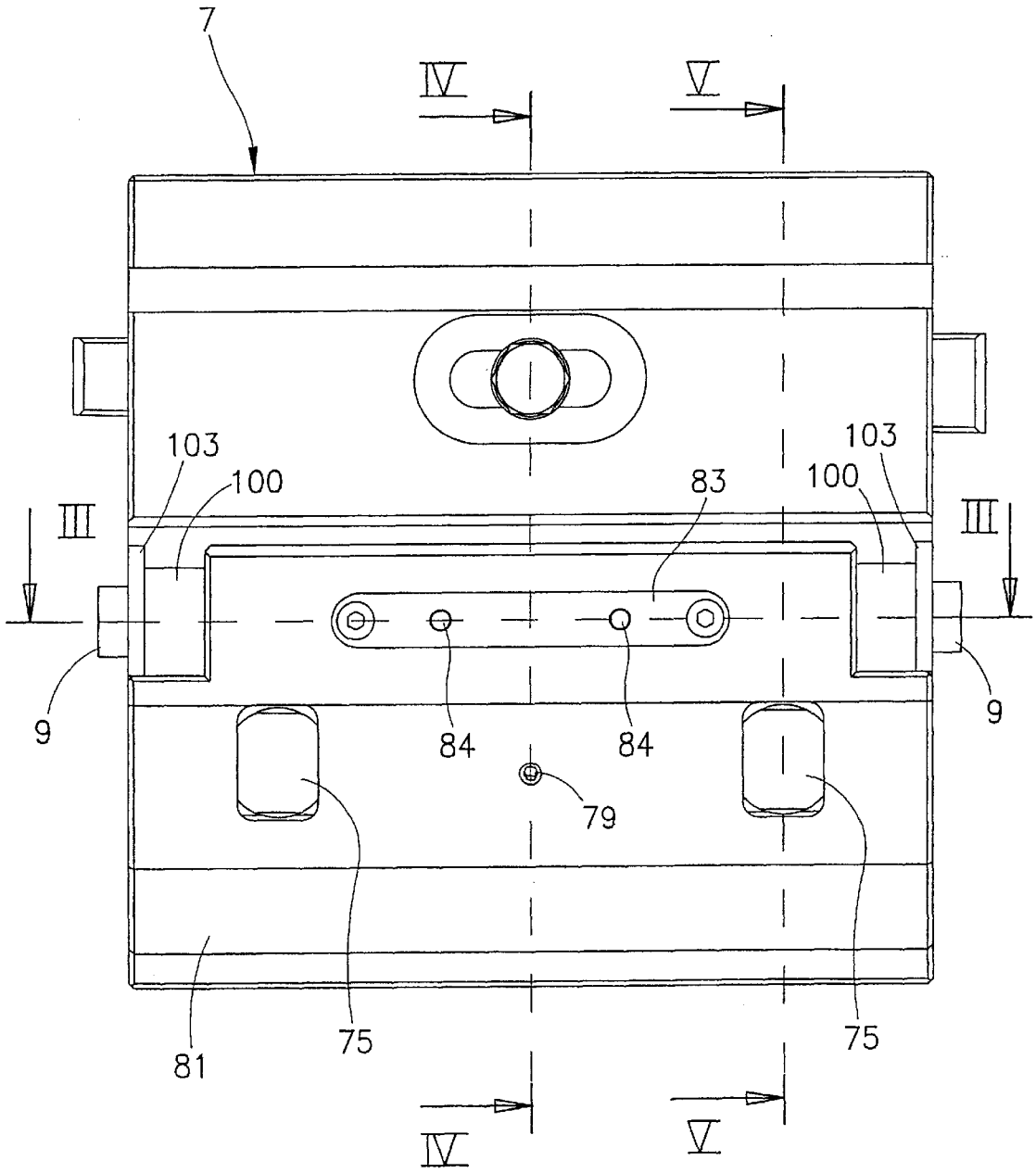
FIG. 2 is a front view of the intermediary of FIG. 1.
Figure 3:
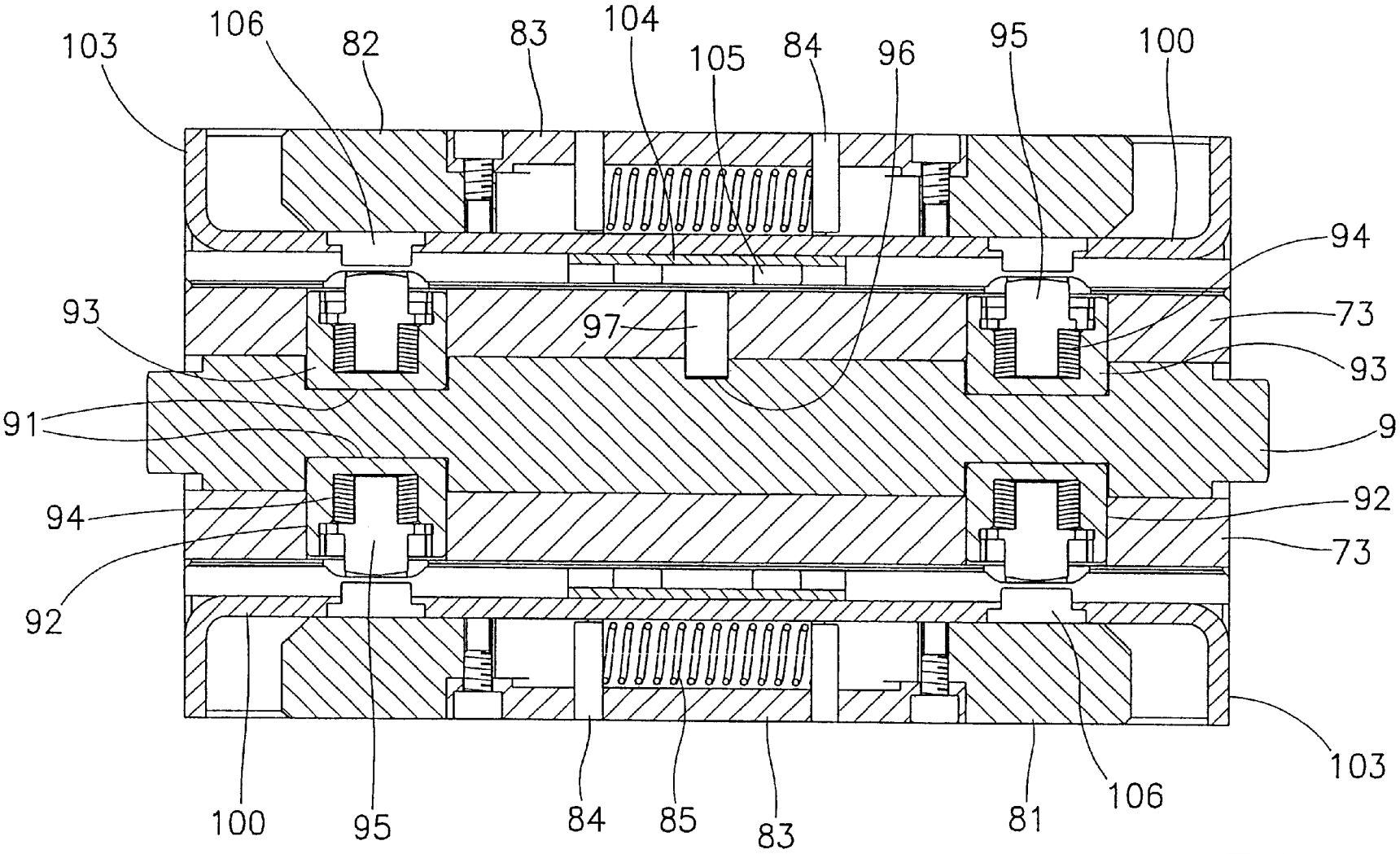
FIG. 3 is a section on the line III—III of FIG. 2.
Figure 4:
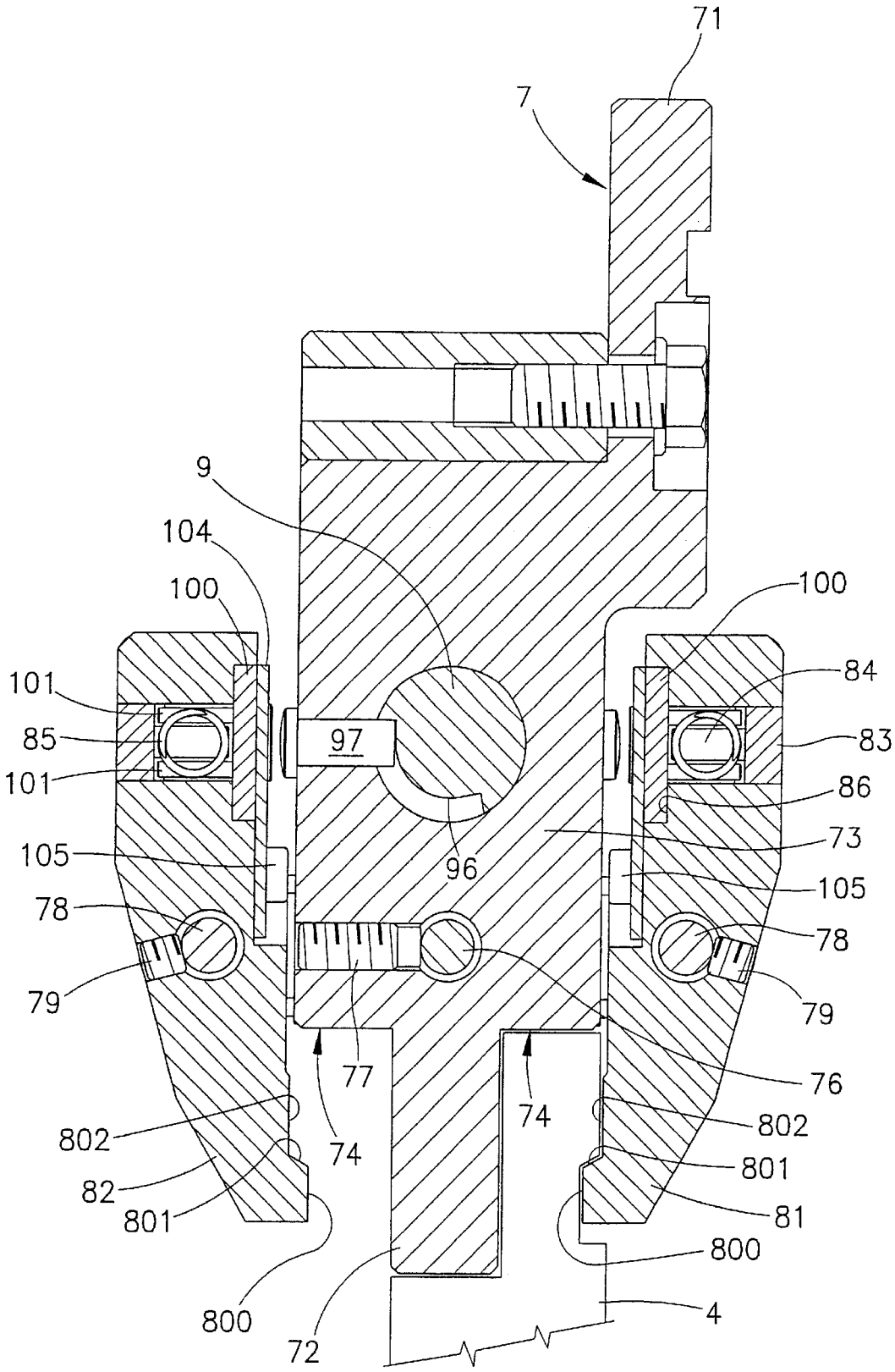
FIG. 4 is a section on the line IV—IV of FIG. 3.

In the first embodiment shown in FIGS. 1 to 5, each intermediary comprises a central body 7 provided upperly with a salient lateral flange 71 for fixing the intermediary to the brake toolplate (FIG. 4).

In an opposite position to the position of the flange 71, the central body comprises along its entire length a lower portion 72 and an intermediate portion 73, which is wider than the portion 72.

At the base of the portion 73 two symmetrical milled recesses 74 (FIG. 5) are provided equidistant from the center of the central body and perpendicular to the axis of the intermediary 6, each of them receiving a bar 75 maintained in position by a central pin 76 of length equal to the length of the central body 7 and locked in position by a central setscrew 77, as shown in FIG. 4.

To the ends of each bar 75 there are hinged two symmetrical profiled jaws 81 and 82 which with the portion 72 of the body 7 define two symmetrical seats for receiving the shank of a tool.

Each jaw has at its end a raised edge 800, the connection surface 801 of which is inclined, and which defines a channel in which the longitudinal tooth 802 of the shank of the tool 4 is positioned, as shown in FIG. 4.

The profiled jaws are hinged to the respective bars by pins 78 of length equal to the length of the body 7, and maintained in position by a central setscrew 79.

Above the pin 76 the body 7 receives a profiled rotatable shaft 9, positioned through the center of the portion 73.

In proximity to its ends, the shaft 9 comprises two pairs of parallel milled cavities facing two through holes 92 in the body 7 having their axis perpendicular to the axis of the shaft 9.

Each hole 92 receives, on one side of the shaft 9 and the other, a cup-shaped piece 93 the base of which rests against that milled recess 91 which faces it.

Each cup-shaped piece receives a pack of spring washers 94 through which a profiled pin 95 with a large head is inserted.

At its center, the shaft 9 presents a circumferential groove 96 extending through about 110° and receiving a stop piece 97 inserted through a hole in the body 7.

It should be noted that in certain embodiments of the invention, the circumferential groove can conveniently extend through a different angle.

The upper portion of each of the jaws 81 and 82 is shorter, as can be seen in FIGS. 2 and 3.

In said portion there is provided an elongate cavity closed by a cover 83 provided with two projecting pins 84 which extend into the cavity.

Between the pins 84, acting as stop pins, there is positioned a spring 85, the purpose of which will be apparent hereinafter.

In an opposite position to the cover, each jaw has a slot 86 extending along its entire length, to movably receive a latch 100 comprising two opposing pairs of stop pins 101 which, when the latch is within the groove, lie respectively at the ends of the spring 85 (FIG. 4).

The latch 100 is therefore free to undergo movement in both directions, being always returned into a central position by the spring 85.

The movements of the latch 100 are produced by the operator acting on its bent ends 103.

The latch 100 is retained in the groove 101 by a central plate 104 (FIG. 4) screwed to the respective jaw 81, 82 by two fixing screws 105.

Figure 5:
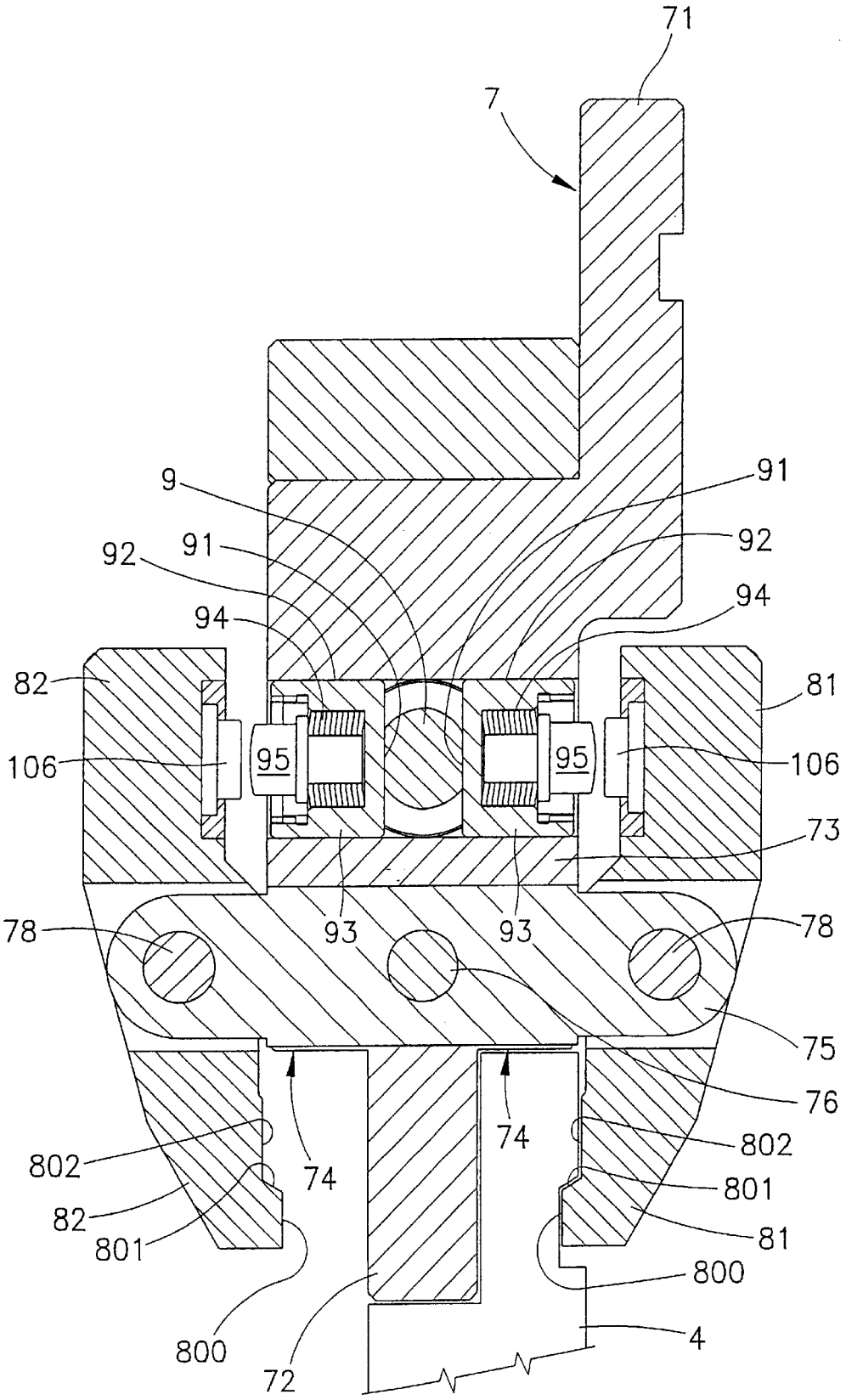
FIG. 5 is a section on the line V—V of FIG. 2.
Figure 6:
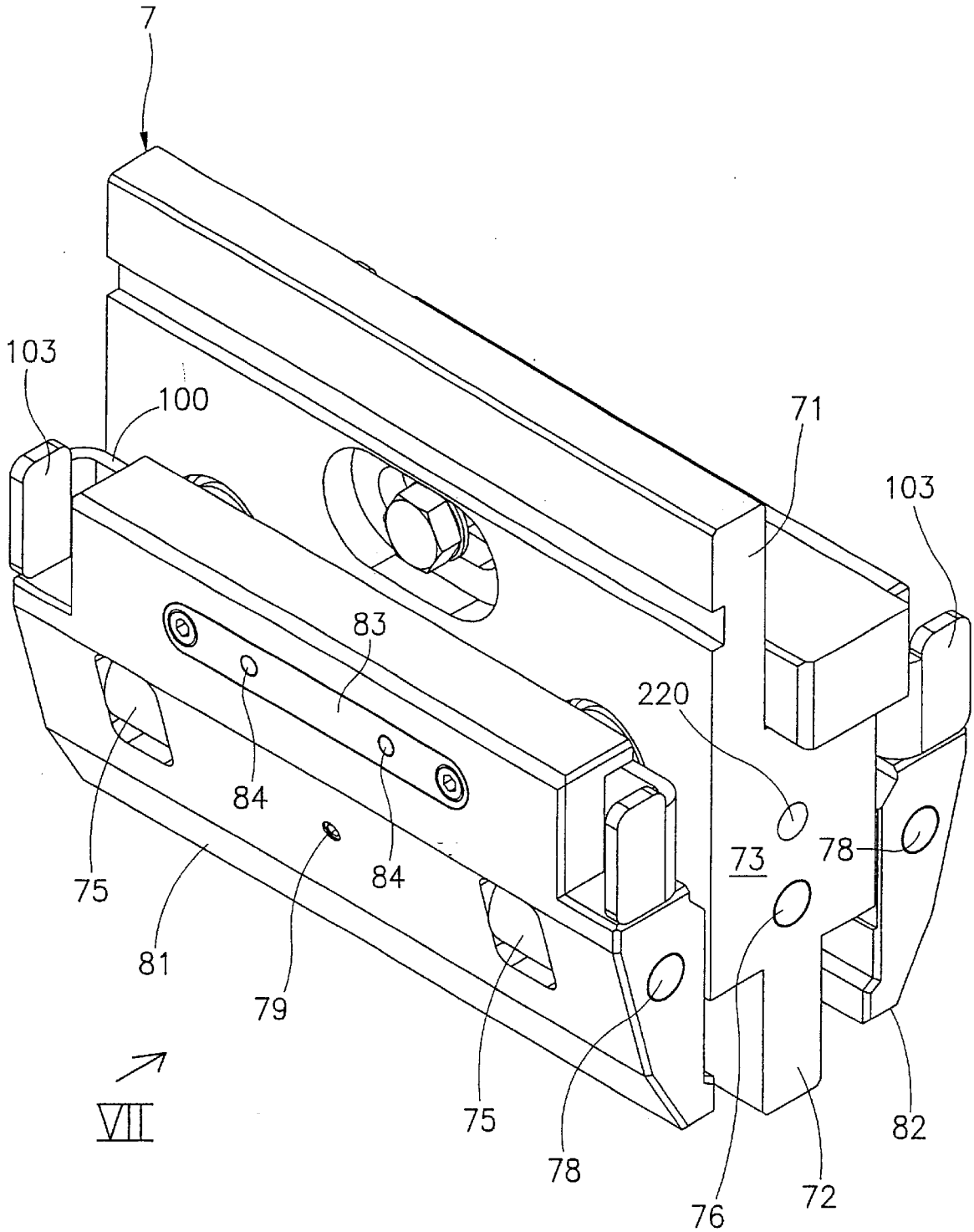
FIG. 6 is an isometric view of a second embodiment of the invention.
Figure 7:
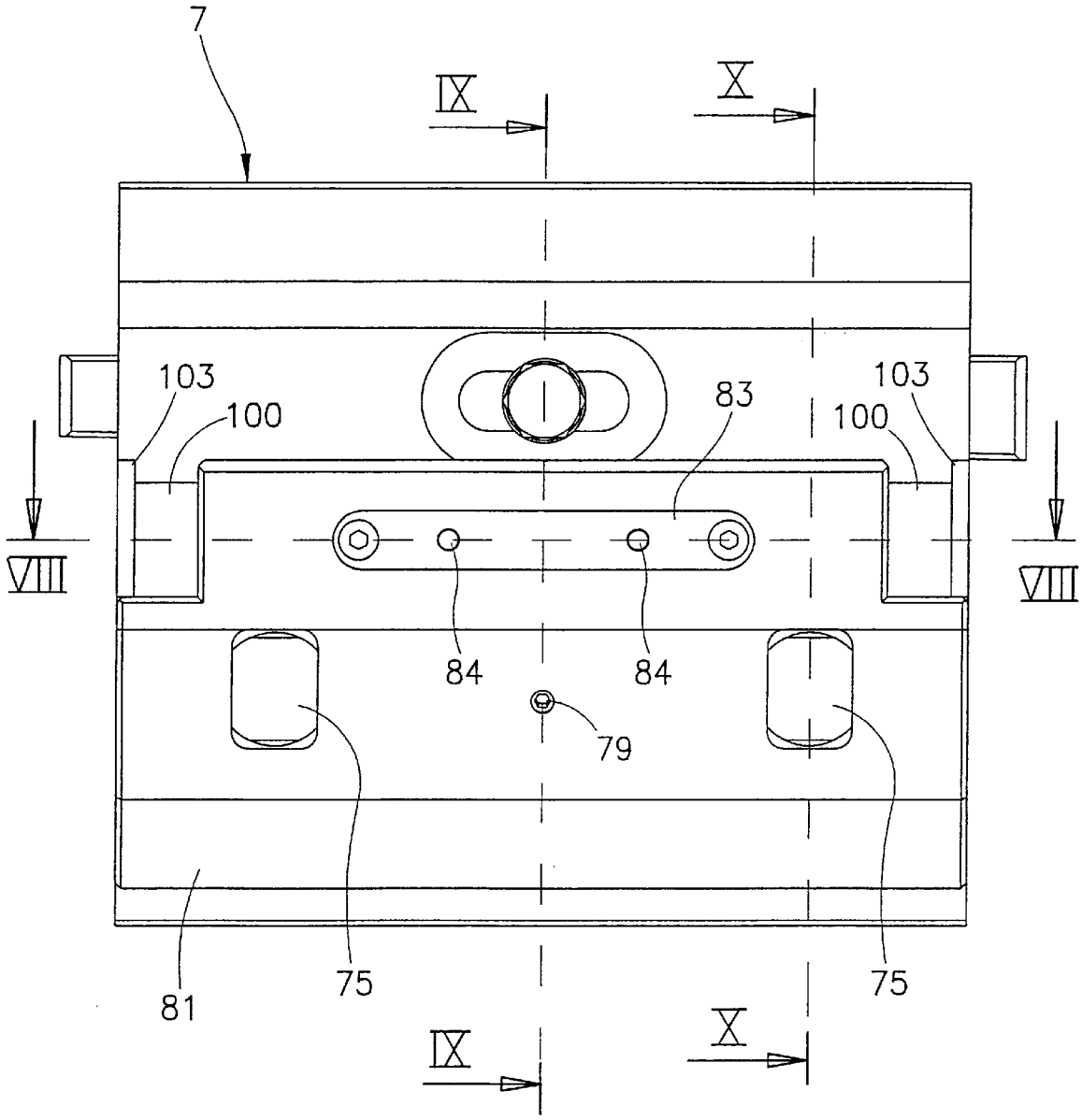
FIG. 7 is a front view in the direction VII of FIG. 6.
Figure 11:
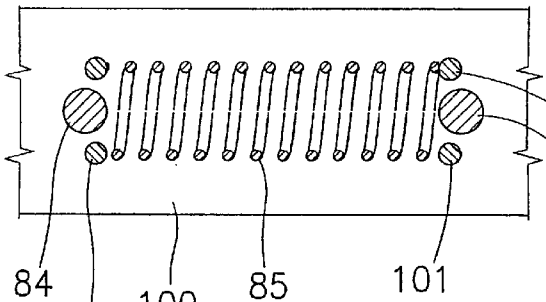
FIG. 11 is a section on the line XI—XI of FIG. 8.

To the sides of the plate 104 the latch 100 comprises two abutments 106 facing the large-headed pins 95 inserted through the spring washers 94, as shown in FIG. 5.

When the latch is in its central rest position, rotation of the shaft 9 through 110° causes the cup-shaped pieces 93 to emerge, the large-headed pins 95 consequently elastically acting on the abutments 106 to rotate the jaw about the pins 78 and clamp the tool.

When the latch 100 is moved from this position, the abutments 106 no longer lie in front of the large-headed pins 95, so that the jaw can no longer be urged into its closed position, and moreover is free to open completely by rotating in the opposite direction, to enable the tool to be withdrawn from below.

The second embodiment of the invention is shown in FIGS. 6 to 11, in which elements corresponding to those of FIGS. 1 to 5 are indicated by the same reference numerals.

In the second embodiment, each intermediary 6 comprises a central body 7 provided upperly with a salient lateral flange 71 for fixing the intermediary to the brake toolplate.

In an opposite position to the position of the flange 71, the central body comprises along its entire length a lower portion 72 and an intermediate portion 73, which is wider than the portion 72.

At the base of the portion 73 two symmetrical milled recesses 74 are provided equidistant from the center of the central body and having their axis perpendicular to the axis of the intermediary 6, each of them receiving a bar 75 maintained in position by a central pin 76 of length equal to the length of the central body and locked in position by a central setscrew 77.

To the ends of each bar 75 there are hinged two symmetrical profiled jaws 81 and 82 which with the portion 72 of the body 7 define two symmetrical seats for receiving the shank of a tool.

The profiled jaws are hinged to the respective bars by pins 78 of length equal to the length of the body 7, and maintained in position by a central setscrew 79.

Figure 8:
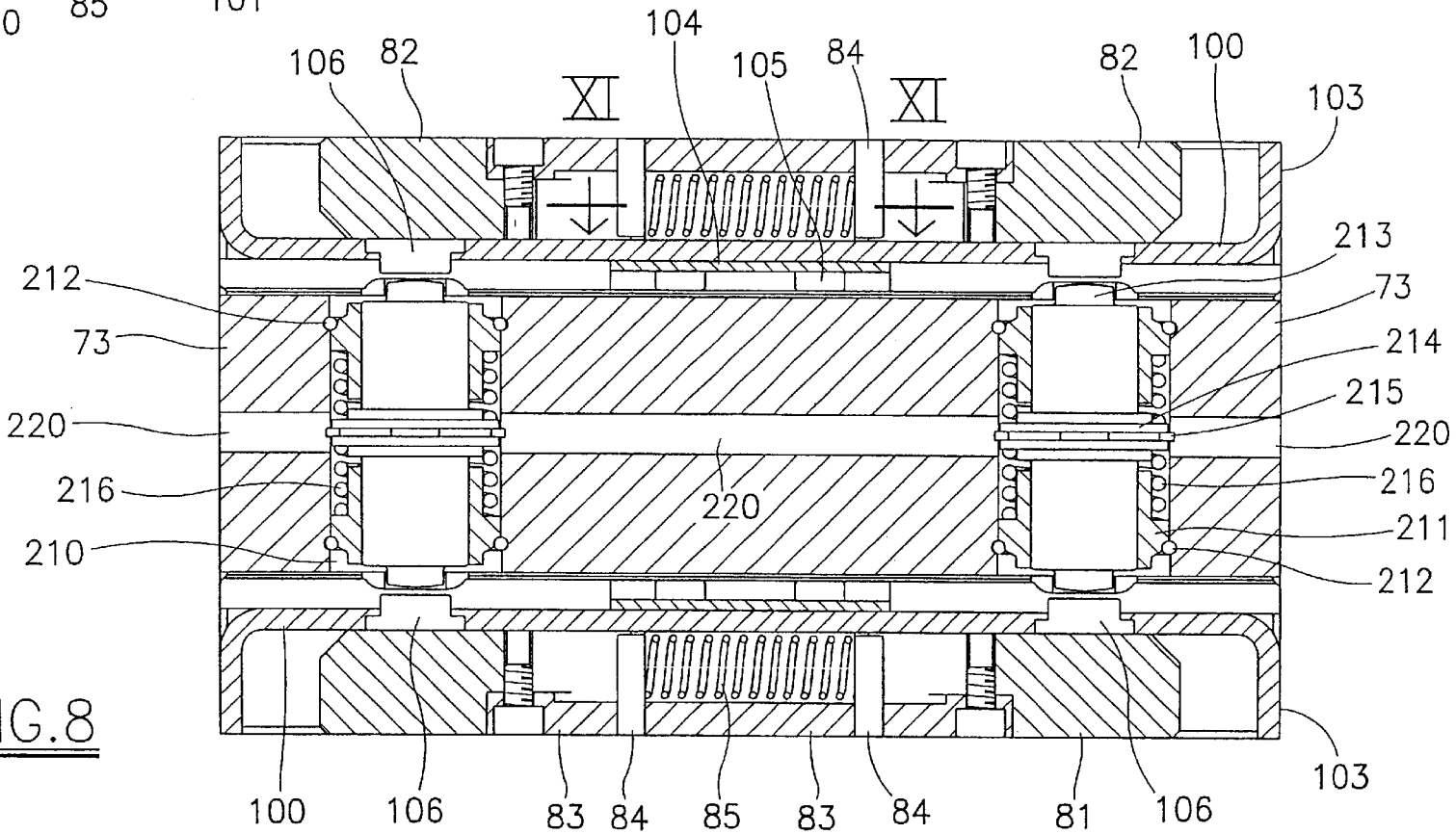
FIG. 8 is a section on the line VIII—VIII of FIG. 7.
Figure 9:
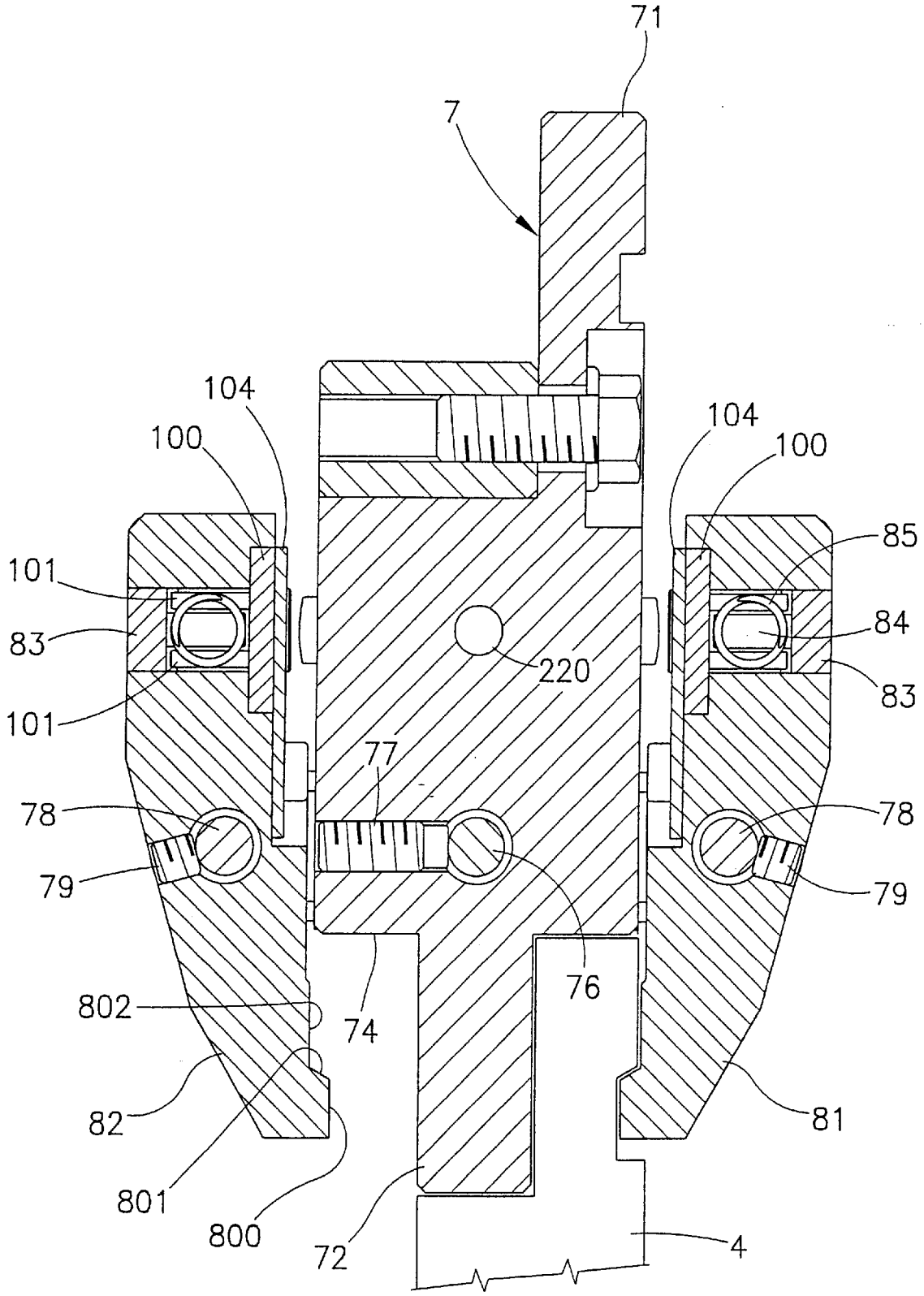
FIG. 9 is a section on the line IX—IX of FIG. 7.

The portion 73 comprises two through holes 210 in proximity to its ends, in positions symmetrical about its center (FIG. 8).

Each hole 210 receives two identical guide pieces 211 arranged symmetrical to each other, and prevented from escaping from their respective hole by a locking ring 212.

In the inside of each guide piece 211 there slides a piston having an end head 213 and a wide base 214.

The base 214 of the two aligned pistons is maintained against a snap ring 215 located in a groove positioned at the centre of the hole 210, but can freely move a certain distance towards the outside of the hole.

Figure 10:
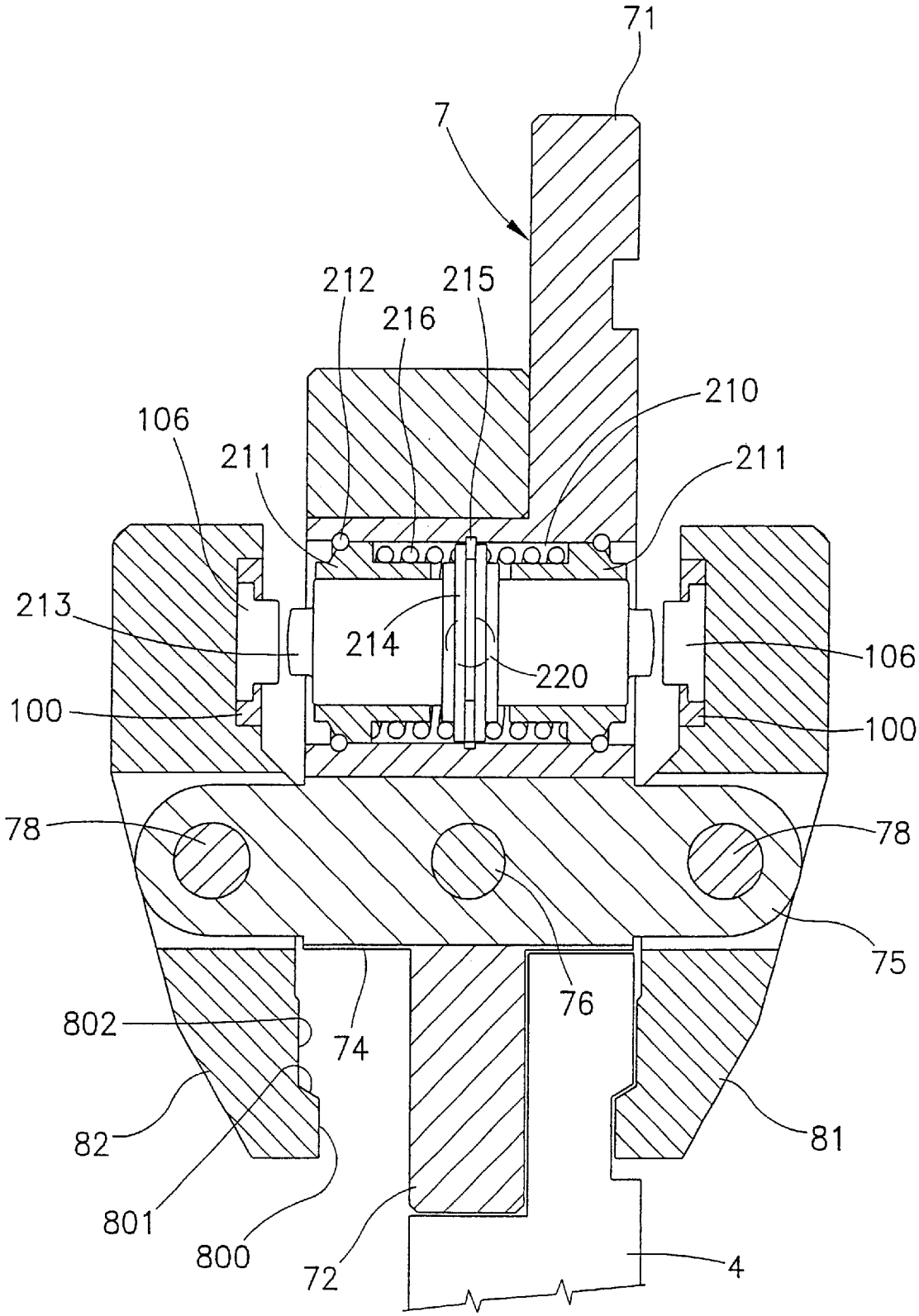
FIG. 10 is a section on the line X—X of FIG. 7.
Figure 12:
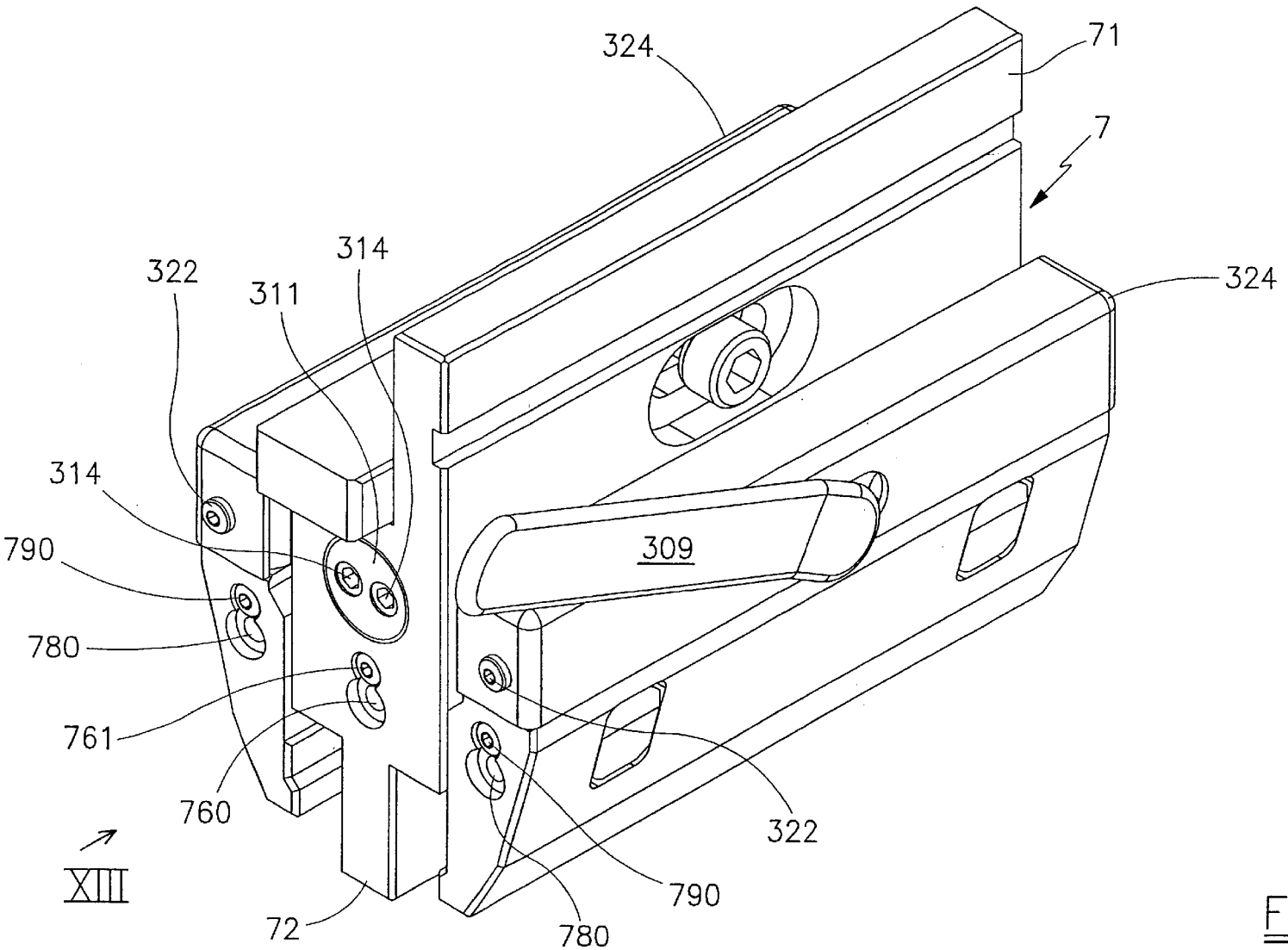
FIG. 12 is an isometric view of a third embodiment of the invention.
Figure 13:
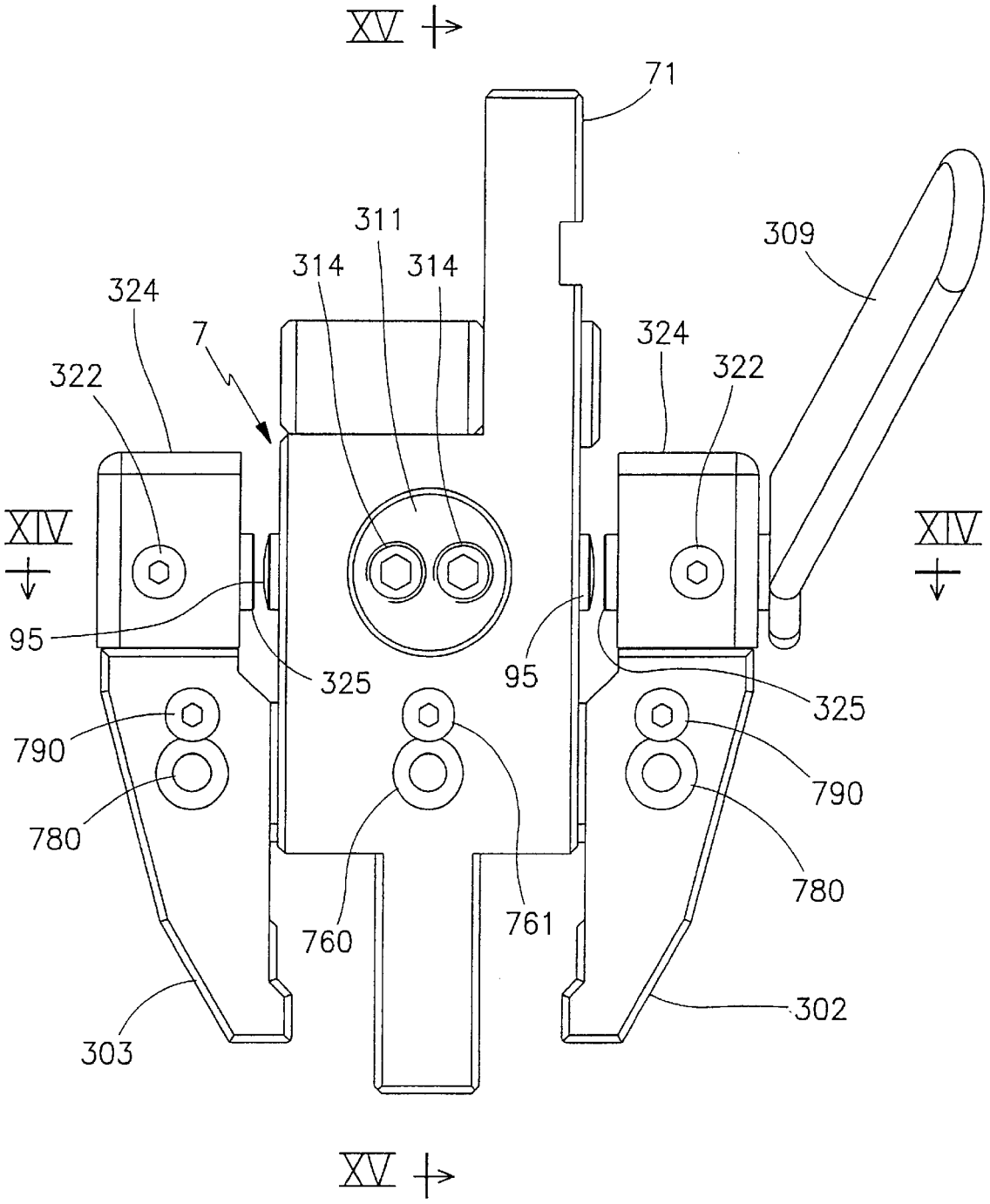
FIG. 13 is a front view in the direction XIII of FIG. 12.

A compression spring 216 positioned between a shoulder on the guide piece 211 and the wide base 214 of the piston maintains this latter in said position as shown in FIG. 10.

The body 7 has a through conduit 220 which intersects the axis of the holes 210 at the snap ring 215 against which the piston bases 214 rest.

Feed and shut-off means for a pressurized fluid (oil) are provided at the ends of the conduit 220, these not being shown as they are easily implemented by an expert skilled in the art.

The jaws 91 and 92 are provided with the same means as in the first embodiment, to the detailed description of which reference should be made.

Their operation is also very similar to the first embodiment.

Feeding the pressurized fluid to the conduit 220 causes the pistons 212 to emerge so that they act on the abutments 106 of the latch 100.

Said action causes the jaw to rotate about the pins 78, with consequent clamping of the tool.

When the latch 100 is moved, the abutments 106 no longer lie in front of the heads 213, hence the jaw is not only no longer urged towards its closed position but is free to open completely by rotating in the opposite direction.

From the a foregoing it will be apparent that when the latch 100 is in its central rest position and the shaft 9 or the pistons 212 are also in their rest position, the tool is supported by the modular support element without being clamped, and hence can be withdrawn from the modular element by sliding it in a horizontal direction.

When the latch 100 is moved from its rest position, the jaws can be moved further apart to enable the tool to be withdrawn from below.

In contrast, when the latch is in its rest position and the shaft 9 or the pistons 212 are operated, the tool is clamped in its working position.

The third embodiment of the invention is shown in FIGS. 12 to 17, in which elements corresponding to FIGS. 1 to 5, which show the initially described embodiment of the invention, are indicated by the same reference numerals.

In the third embodiment each intermediary 6 comprises a central body 7 provided upperly with a salient lateral flange 71 for fixing the intermediary to the brake toolplate.

In an opposite position to the position of the flange 71, the central body comprises along its entire length a lower portion 72 and an intermediate portion 73, which is wider than the portion 72.

Figure 16:
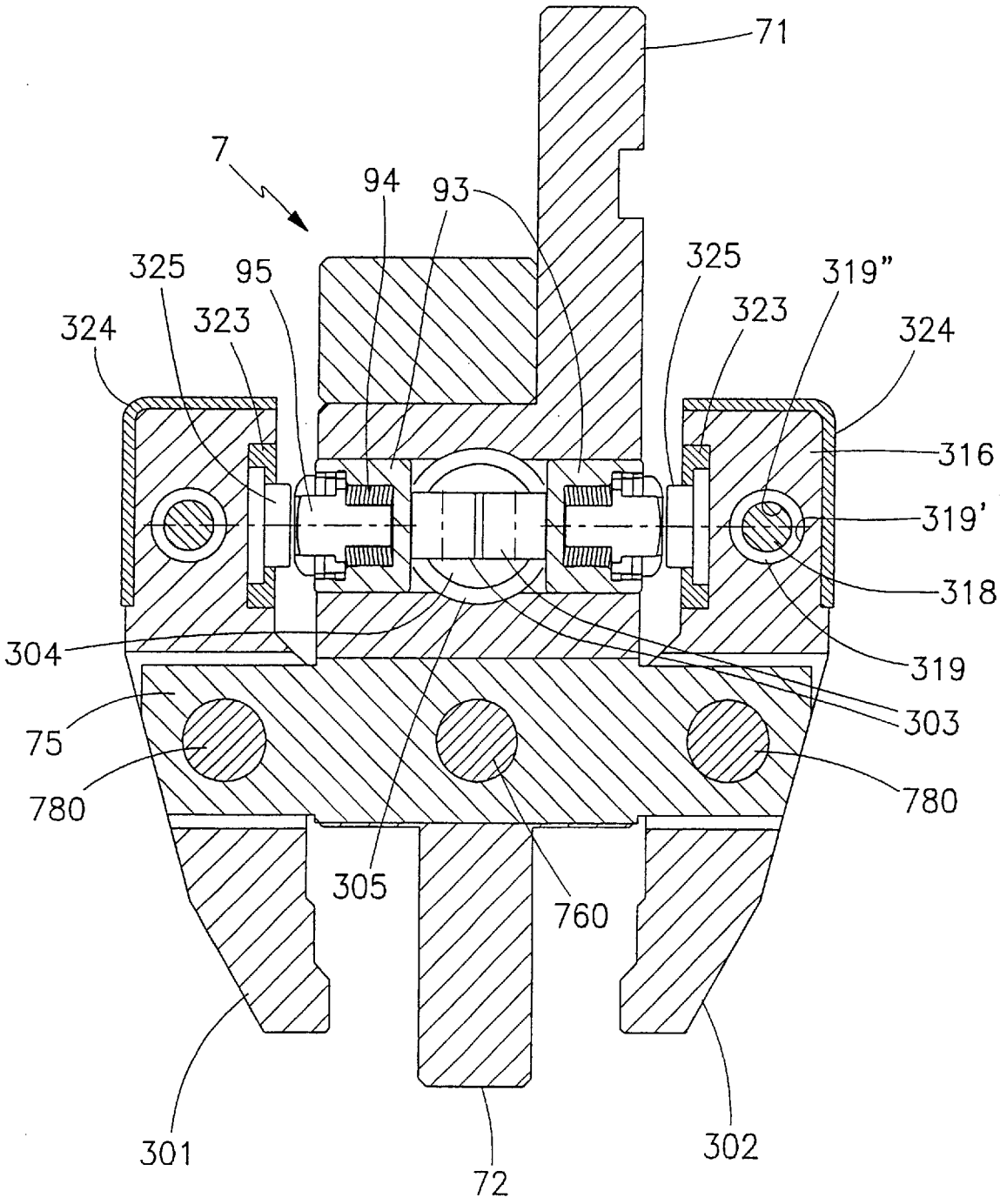
FIG. 16 is a section on the line XVI—XVI of FIG. 15.

With reference to FIG. 16, at the base of the portion 73 two symmetrical milled recesses 74 are provided equidistant from the centre of the central body and having their axis perpendicular to the axis of the intermediary, each of them receiving a bar 75 maintained in position by a central pin 760 locked in position by a central setscrew 761.

To the ends of each bar 75 there are hinged two symmetrical profiled jaws 300 and 301 which with the portion 72 of the body 7 define two symmetrical seats for receiving the shank of a tool.

The profiled jaws 300 and 301 are hinged to the respective bars 75 by pins 780, each of which is locked in position by a setscrew 790.

Above the central pin 760 the body comprises, in positions symmetrical about its centre, a longitudinal through hole 700 and three transverse through holes 701, 702 and 703, the axes B, C, D of which are perpendicular to the axis A of the through hole 700.

The axis C of the hole 701 coincides with the axis of transverse symmetry of the body 7, the holes 702 and 703 being equidistant from said axis C.

Each end of the holes 702 and 703 receives a cup-shaped piece 93 receiving a pack of spring washers 94 through which a profiled pin 95 with a large head is inserted.

Figure 17:
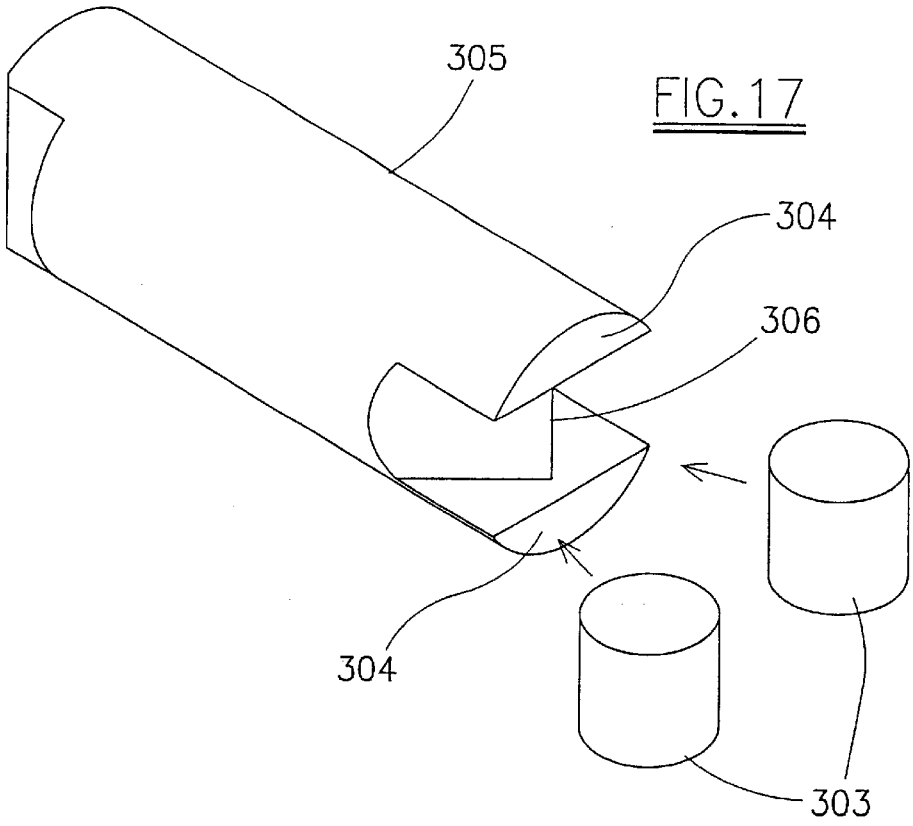
FIG. 17 is a schematic view of a detail of the invention.

The base of said cup-shaped pieces 93 rests against a vertical cylinder 303 which is inserted into the fork-shaped end 304 of a cylindrical piece 305 received in the hole 700. In detail, as shown in FIG. 17, from the crosspiece of said fork 304 there extends a cusp 306 the vertex of which is perpendicular to the inner facing faces of the arms 304' of said fork 304. The vertex of the cusp 306 is spaced from the free end of the arms 304' of the fork 304.

The hole 701 receives a shaft 307, one end of which has a stem 308 which emerges from the body 7 to be fixed to an operating lever 309 for rotating said shaft 307. At the hole 700 the shaft 307 has two parallel milled recesses, each of which receives the rear end of the cylindrical pieces 304 inserted into the hole 700.

Into each end of the hole 700 there is screwed a plug 311 provided with two parallel threaded holes 312 equidistant from its centre.

Each of said holes 312 receives a roller 313 of horizontal axis having its front face resting against one of the vertical cylinders 303. The rollers are retained in position by a rear setscrew 314 screwed into the hole 312.

Each of the jaws 301 and 302 upperly comprises a central projection 315 and two lateral projections 316.

The central projection 315 on the jaw 302 is provided with a hollow 317 for passage of the cylindrical stem 308 connecting the shaft 307 to the lever 309.

Figure 14:
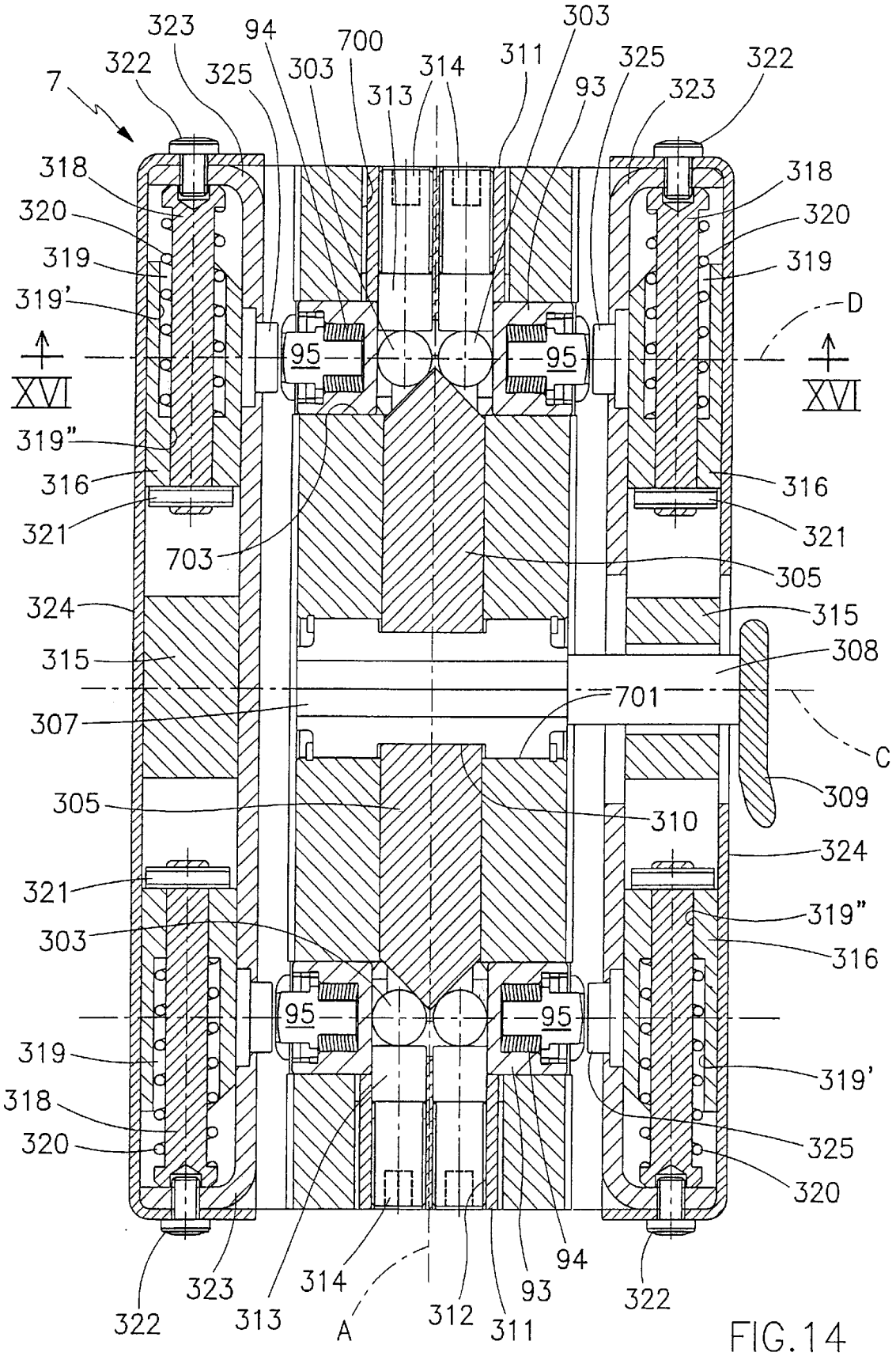
FIG. 14 is a section on the line XIV—XIV of FIG. 13.
Figure 15:
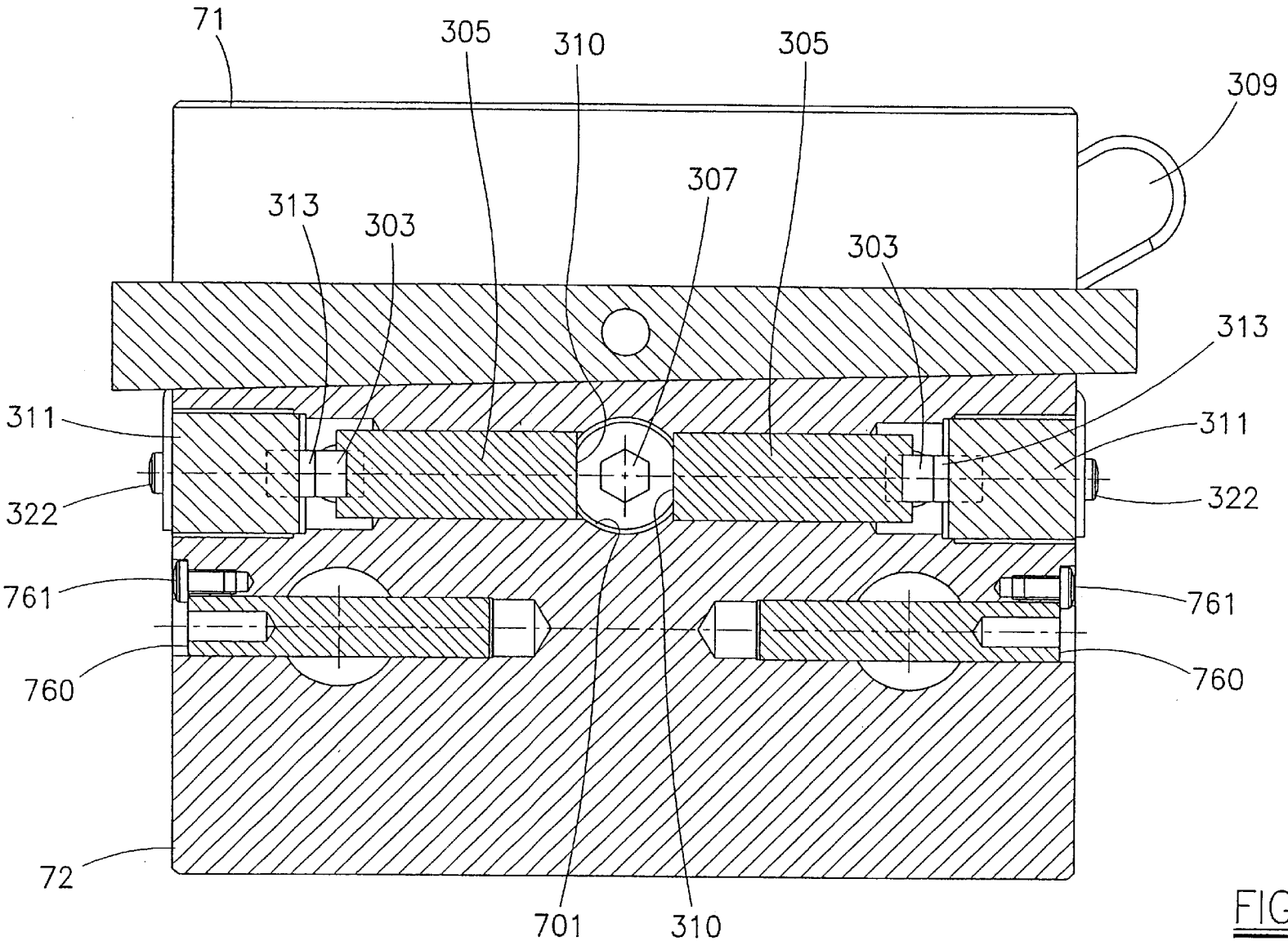
FIG. 15 is a section on the line XV—XV of FIG. 13.

The two lateral projections 316 have a through hole 319 with different sections 319' and 319", which receives a pin 318 about which a spring 320 is mounted. One end of the pin 318 emerges laterally from said projection 316 and is locked by a pin 321. The opposite end of the pin 318 is enlarged to form a base for one end of the spring 320, the other end of which rests on the base of the section 319' of the hole 319, as shown in FIG. 14.

The enlarged ends of the two pins 318 are fixed by a screw 322 to one and the other end of a latch 323 having the same length as one of the jaws 301 or 302.

The screws 322 also fix an external cover 324 to the jaw 301 and 302.

The latch 323 is hence free to move in both directions, being always returned to its central rest position by the springs 320.

From FIG. 14 it can be seen that the latch 323 is provided with two abutments 325 which when the latch 323 is in its rest position lie in front of the pins 95.

The movements of the latch 323 are produced by the operator acting on its bent ends.

When the latch is in its central rest position, rotating the shaft 307 through 90° causes the pieces 305 to move and act on the cylinders 303, so causing the cup-shaped pieces 93 to emerge and the large-headed pins 95 to act elastically on the abutments 325, so that the jaws 301 and 302 rotate about the pins 780 with consequent clamping of the tool 4.

To remove the tool 4, the operator rotates the lever through 90°. after which he moves the latch 323. In this manner the abutments 325 on the latch 323 no longer lie in front of the large-headed pins 95, hence the jaws 301 and 302 are not only no longer urged towards their closed position but are free to open completely by rotating in the opposite direction, to enable the tool to be withdrawn from below.

Figure 20:
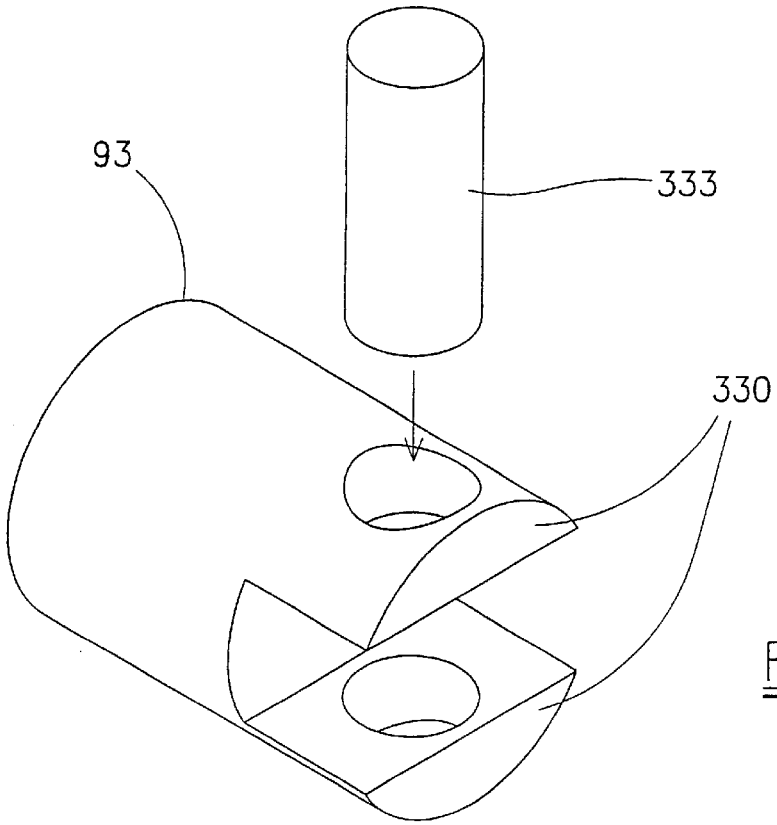
FIG. 20 is an exploded detail of said variant of the third embodiment of the invention.
Figure 18:
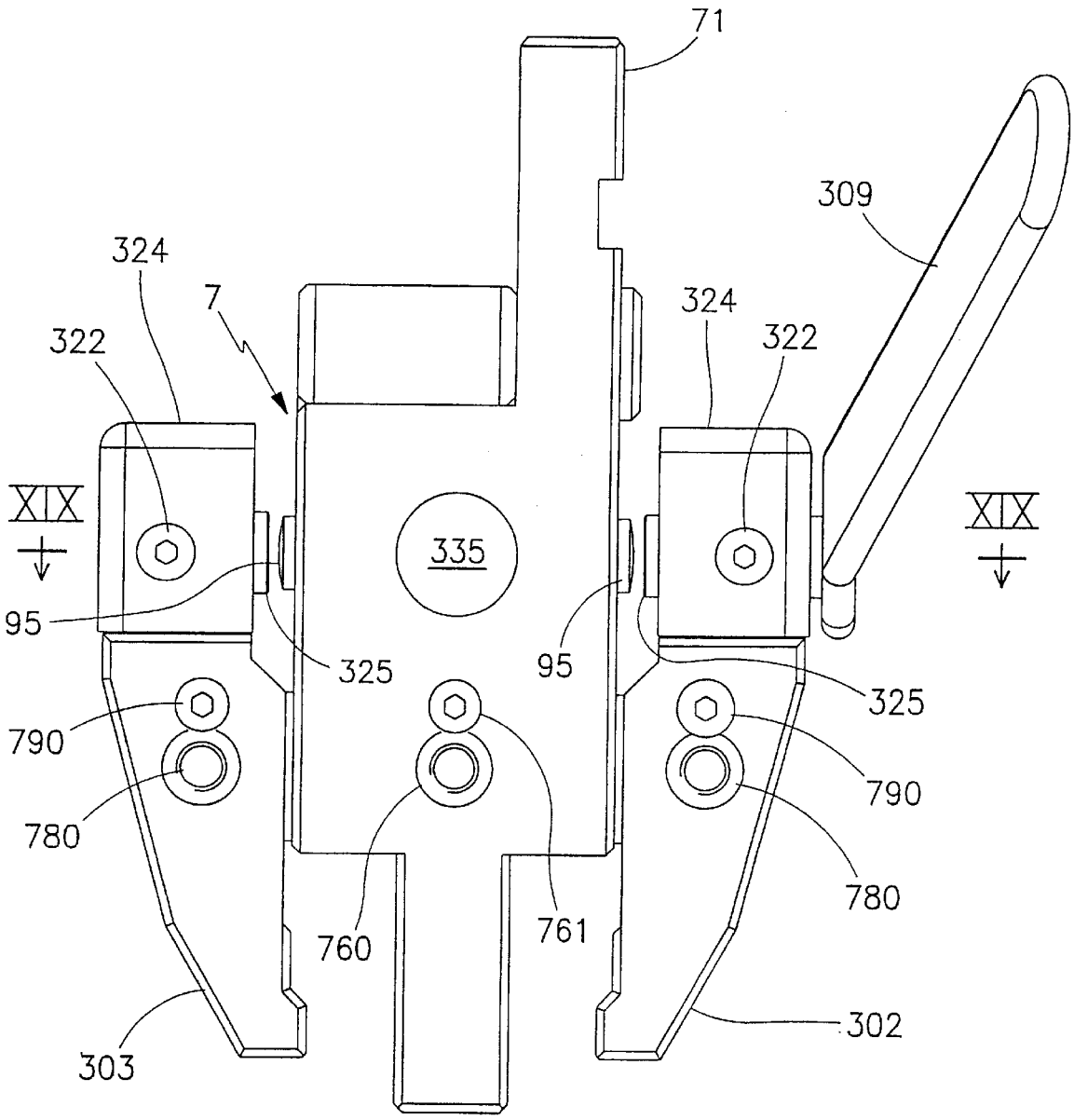
FIG. 18 is a side view of a variant of the third embodiment of the invention.
Figure 19:
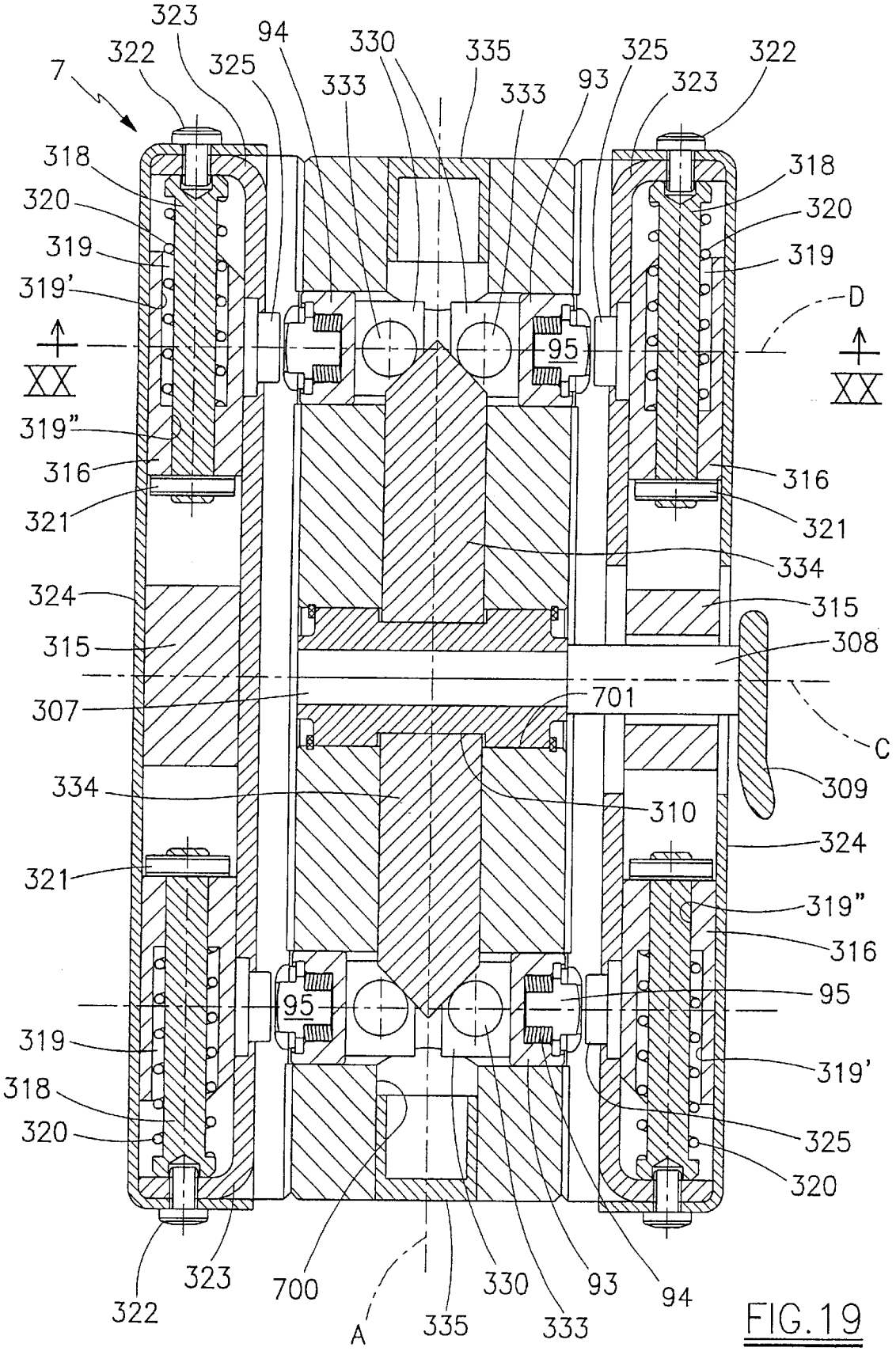
FIG. 19 is a section on the line XIX—XIX of FIG. 18.

FIGS. 18 to 20 show a variant of the third embodiment of the invention. In said figures, elements corresponding to those of FIGS. 12 to 17, which show the third described embodiment of the invention, are indicated by the same reference numerals.

This latter variant of the third embodiment of the invention differs therefrom in the means for rotating the jaws 301 in order to clamp and release the tool 4.

In this variant, from the rear of the cup-shaped members 93 there branches a fork 330, the arms 331 and 332 of which have a hole through which a cylinder 333 is inserted. Said cylinder 333 interferes with the conical end of a cylindrical element 334, the other end of which rests on the base of two milled recesses 310 in the shaft 307.

Two closure plugs 335 are inserted into the ends of the hole 700.

In this case, when the operator rotates the shaft through 90° by means of the lever 309, the cylindrical elements 334 are made to move and press against the lateral surface of the cylinders 333 to cause the cup-shaped pieces 93 and hence the large-headed pins 95 to move outwards. These latter rotate the jaws 301 and 302, which clamp the tool in position.

To release the tool, the operator rotates the lever 309 in the reverse direction. In this manner the spring washers 94 retract the cup-shaped pieces 93 and the pins 95, at the same time the cylinders 333 shifting the cylindrical elements 334.

It should be noted that the invention can receive the tool 5 either from the front or the rear, and that although four possible versions of the invention all with two jaws have been described, it can also be usefully implemented with only one jaw.

What is claimed is:

1. A modular tool support comprising an intermediary member adapted to be fixed to a toolplate and having at least one lower channel for receiving a tool shank provided with a groove along its entire length, means for supporting the shank within said channel while leaving it free to slide along the channel, and means for clamping the shank of the tool in said channel, wherein at least one lower channel is defined by a lateral wall movable jaw which is rotatable about a fixed shaft which is rigid with the body of the intermediary, means for causing said jaw to rotate in a tool clamping direction, and movable abutment means disposed on said jaw said abutment means adapted to be positioned in front of or moved away from said rotation-causing means.

2. That the modular tool support of claim 1, wherein when the movable abutment means are present in front of the rotation-causing means, the rotation of the movable wall is limited to enable the tool shank to slide along the intermediary member, but prevent the tool shank from being withdrawn in the vertical direction.

3. The modular tool support of claim 1, wherein when the movable abutment means are not in front of the rotation-causing means, the jaw can rotate freely until the tool can be withdrawn in the vertical direction.

4. The modular tool support of claim 1, wherein the means for causing the wall to rotate in the tool clamping direction comprise a rotatable shaft which occupies the entire length of the intermediary member and has at least one flat recess against which there elastically rests a large-headed pin which as a result of rotating the shaft, is urged against the movable abutment means.

5. The modular tool support of claim 1, wherein the means for causing the wall to rotate in the tool clamping direction includes at least one piston with its axis perpendicular to the axis of the intermediary member, which is maintained elastically in a retracted position, and is urged by the action of a pressurized fluid against the movable abutment means provided on the jaws.

6. The modular tool support of claim 1, wherein the movable abutment means is slidable in the direction of the axis of the intermediary member and maintained in its rest position by at least one spring, and a latch comprising at least one abutment which when in said rest position faces said jaw rotation-causing means, and when in its working position does not face said jaw rotation-causing means.

7. The modular tool support of claim 1, wherein the jaw rotation-causing means comprises a rotatable shaft which occupies the entire width of the intermediary member and has at least one flat recess which receives the end of an actuator member, the other end of which is associated with at least one vertical cylinder against which there elastically rests a large-headed pin which as a result of rotating the shaft, is urged against said movable abutment means.

8. The modular tool support of claim 7, wherein the end of the actuator member associated with the at least one cylinder is shaped as a fork, with a cusp forming a crosspiece of said fork.

9. The modular tool support of claim 7, wherein the at least one cylinder is partially received between the arms of said fork and rests against one of the walls of said cusp.

10. The modular tool support of claim 1, wherein the at least one cylinder also rests against a roller having a horizontal axis, the position of which can be regulated by means of a rear-lying setscrew.

11. The modular tool support of claim 1, wherein the jaw rotation-causing means comprises a rotatable shaft which occupies the entire width of the intermediary member, said rotatable shaft having at least one flat recess which receives the end of an actuator member, the other end of which is associated with at least one vertical cylinder which is constrained by a large-headed pin, arranged to maintain said cylinder elastically resting against the end of said actuator member, said large-headed pin being urged against said movable abutment means as a result of the rotation of said shaft.

12. The modular tool support of claim 11, wherein the end of said actuator member associated with said at least one cylinder is conical.

13. The modular tool support of claim 1, wherein two parallel lower channels a lateral wall of which is a movable jaw, is provided for receiving and locking the tool shank.

14. The modular tool support of claim 13, wherein the means for causing the jaws to rotate in the tool clamping direction comprise a rotatable shaft which occupies the entire length of the intermediary member and has at least two opposing parallel flat recesses against each of which there elastically rests a large-headed pin, which as a result of rotating the shaft, is urged against the movable abutment means provided on the jaws.

15. The modular tool support of claim 14, wherein the large-headed pins are coaxial.

16. The modular tool support of claim 13, wherein the jaw rotation-causing means comprises a rotatable shaft which occupies the entire length of the intermediary member and has at least two flat recesses each of which receives the end of an actuator member, the other end of which is associated with a vertical cylinder against which there elastically rests a large-headed pin, which, as a result of rotating the shaft, is urged against the movable abutment means.

17. The modular tool support of claim 16, wherein the end of the actuator member associated with the at least one cylinder is shaped as a fork, with a cusp forming a crosspiece of said fork.

18. The modular tool support of claim 16, wherein the at least one cylinder is partially received between the arms of the fork and rests against one of the walls of the cusp.

19. The modular tool support of claim 16, wherein the at least one cylinder also rests against a roller having a horizontal axis, the position of which can be regulated by means of a rear-lying setscrew.

20. The modular tool support of claim 13, wherein the jaw rotation-causing means comprises a rotatable shaft which occupies the entire length of the intermediary member and has at least two flat recesses, each of which receives the end of an actuator member, the other end of which is associated with at least one vertical cylinder which is constrained by a large-headed pin arranged to maintain said cylinder elastically resting against the end of said actuator member, said large-headed pin being urged against said movable abutment means as a result of rotating said shaft.

21. The modular tool support of claim 20, wherein the end of the actuator member associated with the at least one cylinder is conical.

22. The modular tool support of claim 13, wherein the means for causing the jaws to rotate in the tool clamping direction comprise two pistons aligned within the same hole having their axis perpendicular to the axis of the intermediary member, each of which is maintained elastically in a retracted position in contact with an annular stop element positioned at the center of the hole, and is urged simultaneously with the other piston against the movable abutment means provided on the jaws, by the action of a pressurized fluid.

23. A modular tool support comprising an intermediary member adapted to be fixed to a toolplate and having at least one lower channel for receiving a tool shank provided with a groove along its entire length, means for supporting the shank within said channel while leaving it free to slide along the channel, and means for clamping the shank of the tool in said channel, wherein at least one lower channel is defined by a lateral movable jaw which is rotatable about a fixed shaft which is rigid with the body of the intermediary member, means for causing said jaw to rotate in a tool clamping direction, and movable abutment means disposed on said jaw said abutment means adapted to be positioned in front of or moved away from said rotation-causing means, the rotation of the movable jaw being limited so as to enable the tool shank to slide along the intermediary member but not enable the tool to be withdrawn in the vertical direction, and when said movable abutment means are absent in front of the rotation-causing means, the jaw can rotate freely until the tool can be withdrawn in the vertical direction.

24. The modular tool support of claim 23, wherein the movable abutment means is slidable in the direction of the axis of the intermediary member and maintained in its rest position by at least one spring, and a latch comprising at least one abutment, which when in said rest position faces said jaw rotation-causing means, and when in its working position, does not face said jaw rotating-causing means.

25. The modular tool support of claim 23, wherein the means for causing the wall to rotate in the tool clamping direction includes at least one piston with its axis perpendicular to the axis of the intermediary member, which is maintained elastically in a retracted position, and is urged by the action of a pressurized fluid against the movable abutment means provided on the jaws.

26. The modular tool support of claim 23, wherein two parallel lower channels, a lateral wall of which is a movable jaw, is provided for receiving and locking the took shank.

27. The modular tool support of claim 23, wherein the means for causing the jaws to rotate in the tool clamping direction comprise two pistons aligned within the same hole having their axis perpendicular to the axis of the intermediary member, each of which is maintained elastically in a retracted position in contact with an annular stop element positioned at the center of the hole, and is urged simultaneously with the other piston against the movable abutment means provided on the jaws, by the action of a pressurized fluid.

* * * * *

UNITED STATES PATENT AND TRADEMARK OFFICE

CERTIFICATE OF CORRECTION

PATENT NO. : 6,446,485 B1
DATED : September 10, 2002
INVENTOR(S) : Tarasconi

It is certified that error appears in the above-identified patent and that said Letters Patent is hereby corrected as shown below:

Title page,
Insert -- [73] Assignee: TOOLSPRESS S.R.L., Parma, Italy --

Signed and Sealed this

Second Day of September, 2003

JAMES E. ROGAN
*Director of the United States Patent and Trademark Office*